US006648036B2

(12) United States Patent
Watanabe

(10) Patent No.: US 6,648,036 B2
(45) Date of Patent: Nov. 18, 2003

(54) VENEER LATHE

(75) Inventor: Kenzo Watanabe, Ohbu (JP)

(73) Assignee: Meinan Machinery Works, Inc., Ohbu (JP)

( * ) Notice: Subject to any disclaimer, the term of this patent is extended or adjusted under 35 U.S.C. 154(b) by 29 days.

(21) Appl. No.: 10/068,463

(22) Filed: Feb. 6, 2002

(65) Prior Publication Data

US 2002/0148531 A1 Oct. 17, 2002

(30) Foreign Application Priority Data

| | | |
|---|---|---|
| Feb. 6, 2001 | (JP) | 2001-030150 |
| Dec. 14, 2001 | (JP) | 2001-382112 |
| Jan. 30, 2002 | (JP) | 2002-022430 |
| Feb. 4, 2002 | (JP) | 2002-027099 |

(51) Int. Cl.[7] ..... B27L 5/02; B27L 5/04

(52) U.S. Cl. ..... 144/213; 144/209.1; 144/365; 384/99; 384/132; 482/30; 482/35

(58) Field of Search ..... 144/209.1, 213, 144/213 A, 356, 357, 365, 382, 394, 404, 242.1, 246.1; 492/29, 30, 33, 34, 35; 384/99, 132

(56) References Cited

U.S. PATENT DOCUMENTS

| | | | | |
|---|---|---|---|---|
| 4,602,663 A | | 7/1986 | Browning, Jr. et al. | |
| 4,790,360 A | * | 12/1988 | Clarke et al. | 144/213 |
| 5,141,038 A | * | 8/1992 | Nakaya et al. | 144/213 |
| 5,927,360 A | | 7/1999 | Nakamura et al. | |
| 5,971,045 A | | 10/1999 | Watanabe | |

* cited by examiner

*Primary Examiner*—W. Donald Bray
(74) *Attorney, Agent, or Firm*—Burr & Brown

(57) ABSTRACT

A veneer lathe that can provide a veneer produced by cutting out a log, which is substantially free from surface scratches, and thus can be used as a surface sheet for plywood. A roller bar drives a log while pushing its peripheral surface on the upstream side of a knife fixed to a knife carriage for cutting the rotating log in a log rotating direction. The roller bar 3 has a large number of grooves defined in a peripheral surface thereof. The shape of the grooves 5*a* in a section crossing the shaft centerline of the roller bar 3 is set so that an angle between a tangent at a corner portion 3*e* constituted by a line 3*d* of an outer periphery of the roller bar 3 and a line 3*b* extending outward from an upstream side face of the grooves 5*a* is 130 to 160 degrees.

18 Claims, 17 Drawing Sheets

FIG. 17 - PRIOR ART

FIG. 18 - PRIOR ART
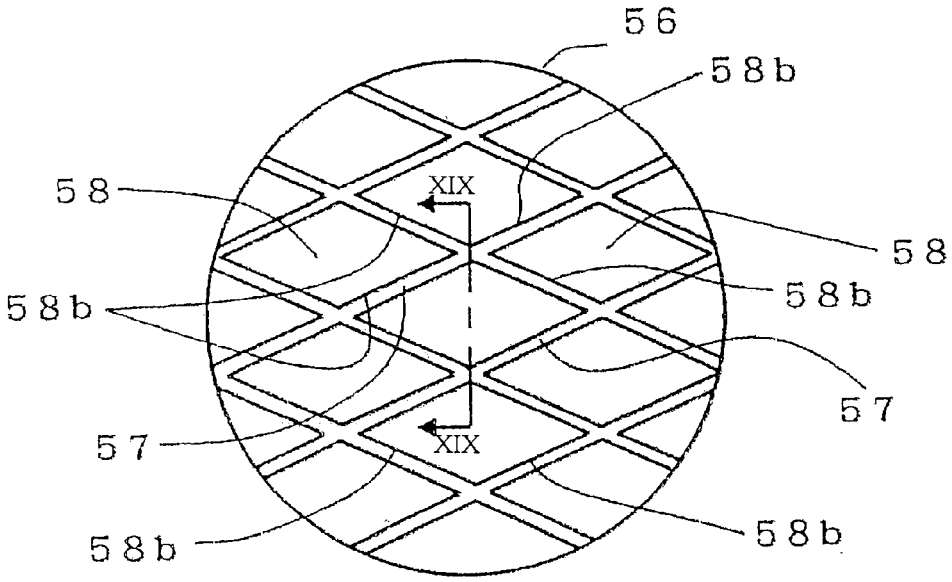
FIG. 19 - PRIOR ART
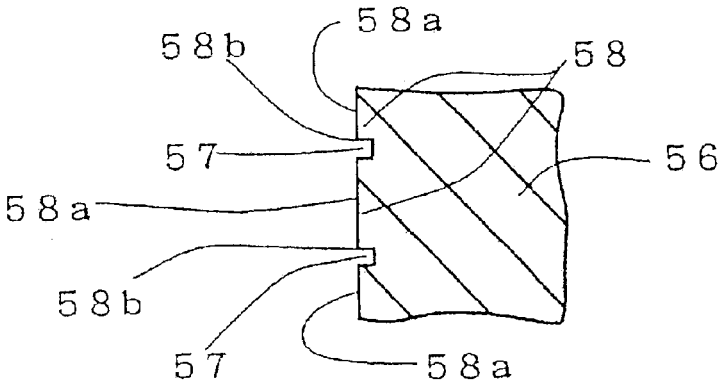

VENEER LATHE

BACKGROUND OF THE INVENTION

This application claims the benefit of Japanese Application Number 2001-30150 filed Feb. 6, 2001, Japanese Application Number 2001-382112 filed Dec. 14, 2001, Japanese Application Number 2002-22430 filed Jan. 30, 2002 and Japanese Application Number 2002-27099 filed Feb. 4, 2002, the entirety of each of which are incorporated herein by reference.

1. Field of the Invention

This invention relates to a veneer lathe including a roller bar for cutting out thin wood sheets (hereinafter called "veneers") from a log.

2. Description of the Related Art

The applicant of this application previously proposed a veneer lathe described in Japanese Patent Laid-Open No. 99507/1999.

This veneer lathe includes a large number of projections disposed round a peripheral surface of a roller bar to a height not protruding from the peripheral surface. The veneer lathe also includes a sliding bearing that is fixed to a knife carriage, which rotatably supports the roller bar, has an arcuate sectional shape opening on the side of a log in a section crossing the shaft centerline of the roller bar, and is so provided as to oppose the log on the opposite side of the log with the roller bar being the center. The veneer lathe further includes a driving source for rotating the roller bar held by the sliding bearing.

The roller bar having the construction described above transmits at least a part of the force necessary for cutting the log. It can also play the role of a pressure bar.

In the veneer lathe described above, the following construction is also disclosed. As shown in FIG. 17, a large number of spiral grooves 57 having a depth of 0.5 mm and a width of 0.5 mm and crossing one another at an angle of 15 degrees in the shaft center line direction are arranged on the peripheral surface of the roller bar 56 in gaps of 3 mm among them in the rotating direction. In this way, diamond projections 58 are disposed on the surface of the roller bar 56 and the surface 58*a* of each projection is smooth.

FIG. 18 is an enlarged view of a portion encircled by circle 59 shown in FIG. 17. FIG. 19 is a partial sectional view taken along line XIX—XIX in FIG. 18.

As a result, the projections 58 are cut into the peripheral surface of the log on the side where the roller bar 56 is brought into contact with the log. The edge of each projection 58 (on the downstream side of each projection in the rotating direction when the roller bar 56 rotates from above to below in FIG. 18) is caught by the peripheral surface of the log. Consequently, large force can be transmitted to the log in the same way as in the case described above.

However, the veneer lathe described above leaves a large number of fine scratches on the surface of the resulting veneer layer, depending upon the kind of log used. Therefore, the veneer layer produced by this veneer lathe cannot be used for a surface sheet of plywood that is required to be substantially free from surface scratches.

In the case of the veneer lathe using the roller bar shown in FIGS. 17 to 19, when the grooves of the roller bar are clogged with fiber chips of the log, the fiber chips do not easily fall off. As cutting is continued, the grooves are entirely clogged with the fiber chips. In consequence, the roller bar cannot adequately engage the peripheral surface of the log, and cannot transmit a large force to the log.

SUMMARY OF THE INVENTION

To solve the problems described above, the present invention provides the following structures.

According to a first aspect of the invention, there is provided a veneer lathe including a knife fixed to a knife carriage for cutting a rotating log. A roller bar is provided at a position for pushing a peripheral surface of the log on the upstream side of the knife in a log rotating direction, and has a plurality of grooves formed on the peripheral surface thereof. Sliding bearings are provided for rotatably supporting the roller bar, and are fixed to the knife carriage. The sliding bearings have, when viewed in a section crossing the centerline axis of the roller bar, an arcuate sectional shape opening to the log, and are arranged so as to oppose the log on the opposite side of the log with the roller bar being the center. A driving source is also provided for rotating the roller bar supported by the sliding bearings. The shape of the grooves in the section crossing the centerline axis of the roller bar is such that an angle between a tangent at a corner of the groove on the upstream side of the roller bar in a rotating direction, which is constituted by a line on the outer periphery of the roller bar, and a first line extending outward from the upstream side face defining the groove, is 130 to 160 degrees. Consequently, the corners of the rotating roller bar on the upstream side of the rotating direction of the grooves cut and anchor into the peripheral surface of the log, and the roller bar can transmit sufficient force for cutting the log. On the other hand, scratches that can be visually recognized hardly remain on the peripheral surface of the log brought into contact with the roller bar.

According to a second aspect of the invention, there is provided the veneer lathe described above wherein the shape of the grooves in a section crossing the centerline axis of the roller bar is such that an angle between a tangent at a corner of the groove on the upstream side of the roller bar in a rotating direction, which is constituted by a line on an outer periphery of the roller bar, and a first line extending outward from the upstream side face defining the groove, is 130 to 160 degrees, an angle between a second line extending outward from the downstream side face defining the groove and the first line is at least 70 degrees, and a depth from the outer peripheral surface of the roller bar to the bottom of the groove is at least 0.05 mm. Therefore, even when wood fibers separated from the log enter the grooves of the roller bar, they can easily fall off from the grooves due to their own weight. Further, the roller bar can stably transmit force to the log, since the corner of the grooves catches the wood fibers.

In accordance with another embodiment, the grooves are spirally disposed in the peripheral surface with respect to the centerline axis, and the grooves are brought into pressure contact with the fiber of the log while the corners of the groove of the roller bar on the upstream side in the rotating direction cross one another. Therefore, it becomes more difficult to visually recognize surface scratches in the resulting veneer.

In accordance with yet another embodiment, the grooves are disposed on the peripheral surface of the roller bar in parallel with the direction of the centerline axis of the roller bar, such that the grooves can suitably correspond to the fiber of the log and can establish the cut-in state. Therefore, driving force can be transmitted reliably.

In accordance with still another embodiment, the grooves and the smooth peripheral surface are alternately arranged on the roller bar in the direction of the centerline axis of the roller bar. Therefore, the roller bar can be kept more stably at the set position by the inner peripheral surface of a holding member.

In accordance with still another embodiment, the sliding bearings are split into a large number and aligned in the direction of the centerline axis of the roller bar, such that exchanging defective bearings and production of the bearing itself can be conducted more easily.

The bearings can also be arranged with gaps between them in the direction of the centerline axis of the roller bar, such that the number of components can be decreased.

In a preferred embodiment, the lathe also includes a holder fixed at one end to the knife carriage in a cantilever arrangement, and coupled to the sliding bearings at the other end thereof, since the bearing is likely to undergo deflection in a departing direction from the log when a large wood chip intrudes between the roller bar and the log. Therefore, excessive force does not act on both the log and the sliding bearings, and their breakage can be reduced.

Preferably, the diameter of the roller bar is not greater than 20 mm, such that pressure can be imparted to the log at a position in the proximity of the knife, and a veneer free from back-cracking can be obtained. On the other hand, the diameter of the roller bar is appropriately at least 12 mm, because as the log becomes thinner with cutting, it does not shrink in the radial direction owing to the pressure.

It is also possible to provide a backup roller facing the log at a position opposite to the knife. The backup roller moves so as to follow the peripheral surface of the log while the diameter of the log decreases with cutting. In this way, driving force can be imparted to the log at a suitable pressing force that does not invite shrinkage of the log even when the log becomes thin with the progress of cutting.

Incidentally, the term "centerline axis of the roller bar" represents an imaginary line along the center of revolution of the roller bar.

BRIEF DESCRIPTION OF THE DRAWINGS

FIG. 17 is a partial explanatory front view of a roller bar according to a prior art example;

FIG. 18 is an enlarged explanatory view of a portion encompassed by a circle 59 in FIG. 17; and FIG. 19 is an explanatory view of a section taken along line XIX—XIX in FIG. 18.

DETAILED DESCRIPTION OF THE INVENTION

Next, a preferred embodiment of the invention will be explained.

Figure 1:
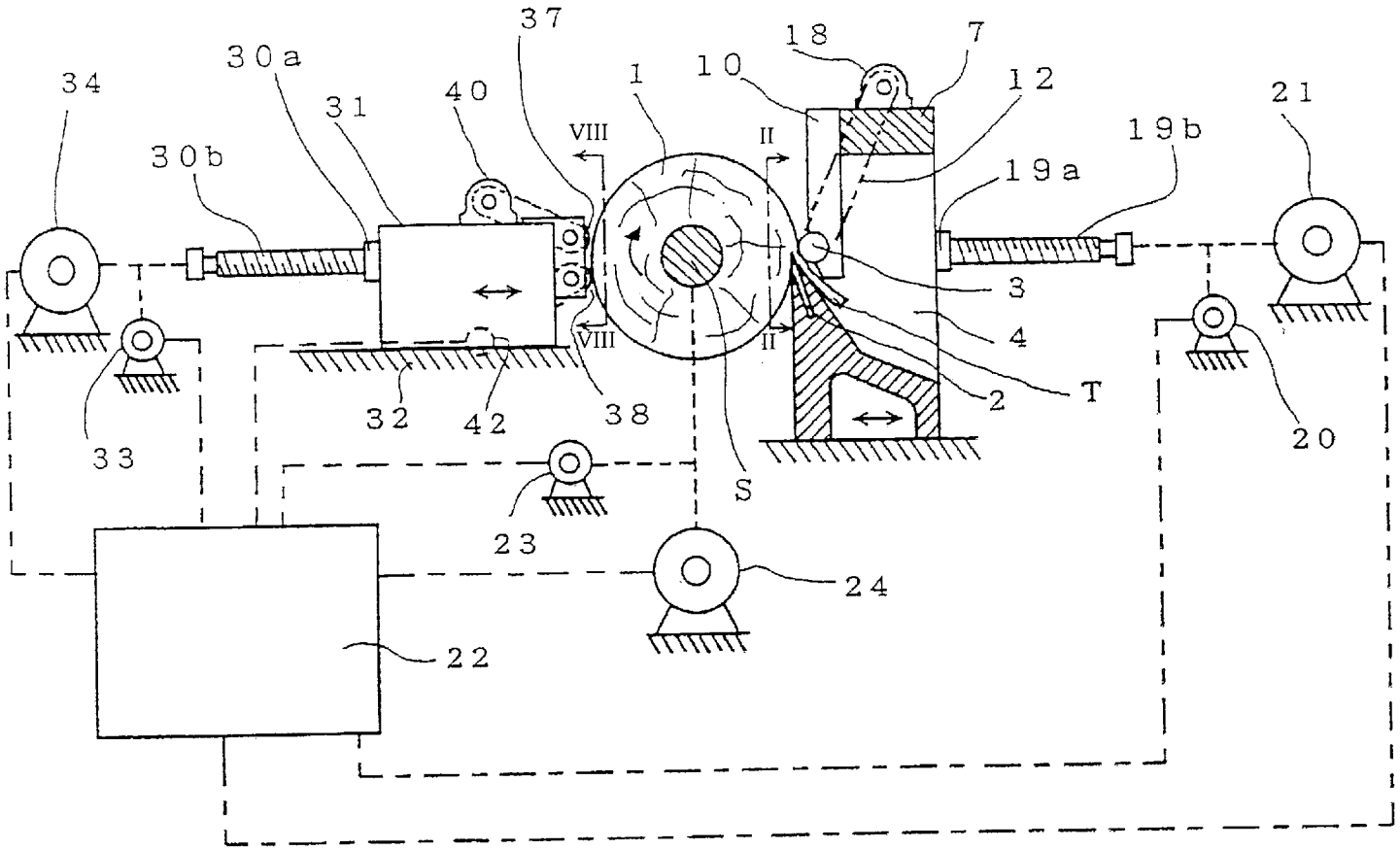
FIG. 1 is an explanatory side view of an embodiment of the invention.

A veneer lathe includes a pair of spindles S capable of moving back and forth in an axial direction of a log 1, and a knife carriage 4 equipped with a knife 2 for cutting the log 1, rotatably supported by the spindles S, and with a roller bar 3, as shown in the explanatory side view of FIG. 1.

Figure 2:
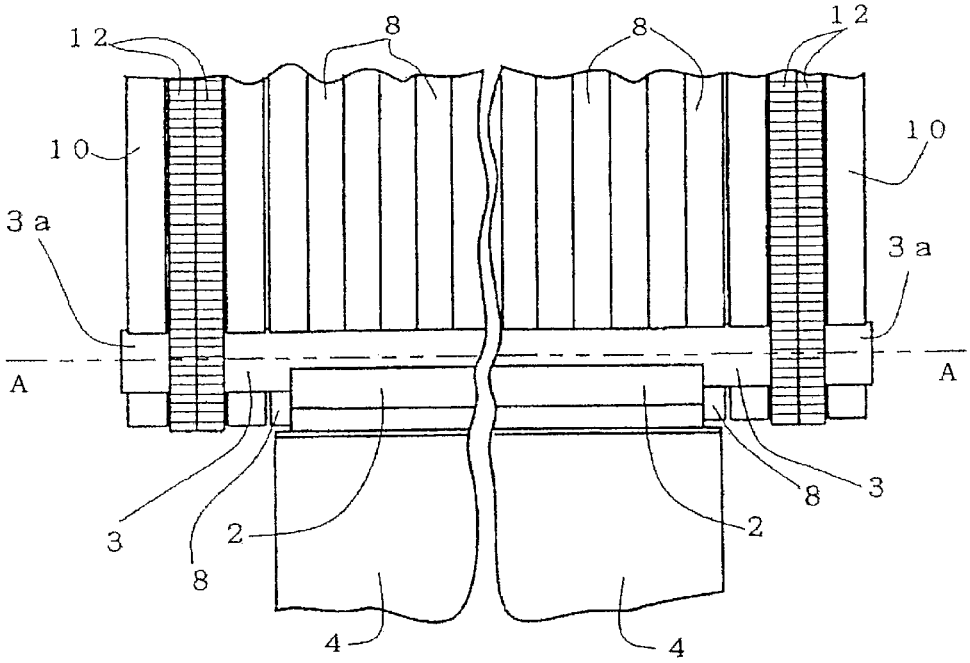
FIG. 2 is an explanatory front view showing a partially omitted state where a material wood 1 is removed, as viewed along line II—II in FIG. 1.
Figure 3:
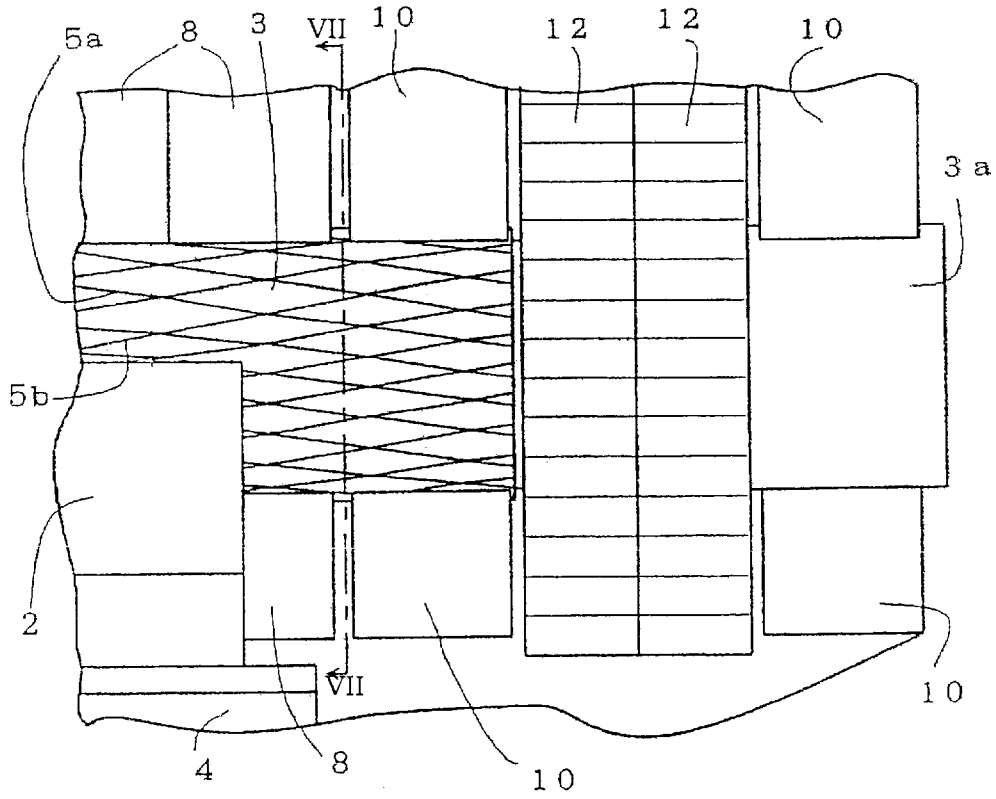
FIG. 3 is an explanatory front view showing a portion near the right end side in FIG. 2 in partial enlargement.

FIG. 2 is an explanatory front view taken along line II—II of FIG. 1, and shows the state, partly in omission, where the log 1 is removed. FIG. 3 is a partial enlarged view of a portion near the right side in FIG. 2. As shown in FIGS. 2 and 3, the roller bar 3 is arranged in parallel with the edge of the knife 2.

Figure 4:
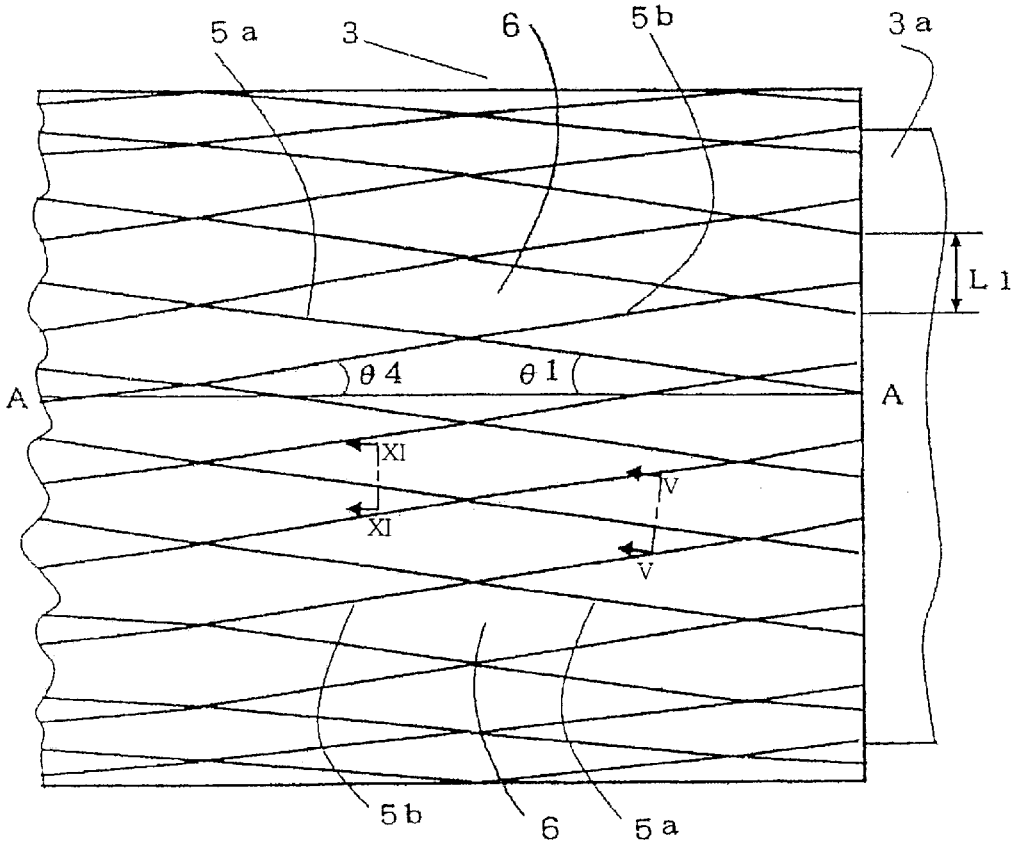
FIG. 4 is a partial enlarged explanatory view of an end portion of a roller bar.
Figure 5:
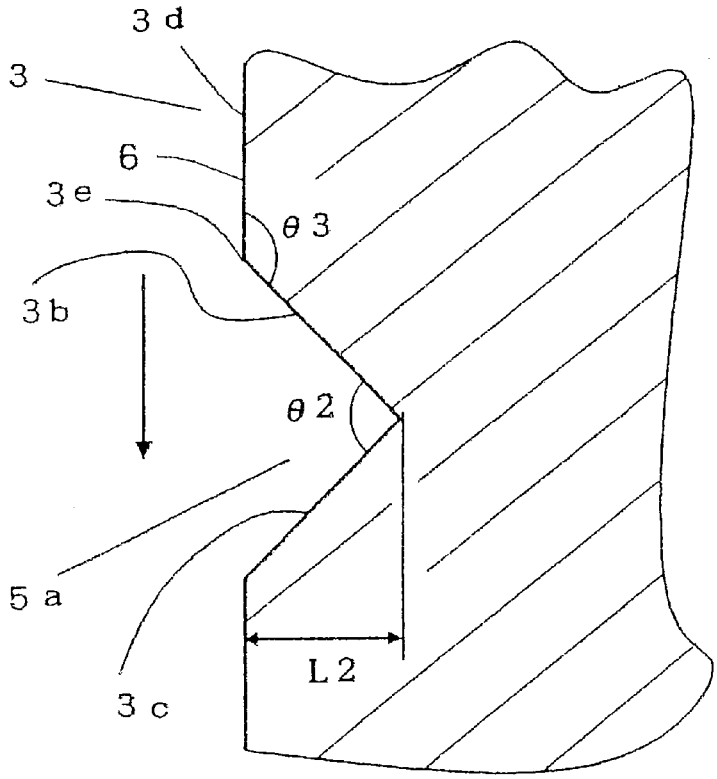
FIG. 5 is an enlarged explanatory view of a section taken along line V—V in FIG. 4.

FIG. 4 is a partial explanatory front view of an end portion of the roller bar 3 in FIG. 3. FIG. 5 is an enlarged explanatory view of a partial sectional view taken along line V—V of FIG. 4. The roller bar 3 is a round bar having a diameter of 16 mm. Grooves 5*a* and 5*b* are defined in the peripheral surface of the roller bar 3 as shown in FIGS. 3, 4 and 5.

Side faces 3*b* and 3*c* (FIG. 5) corresponding respectively to first and second lines define the groove 5*a* as shown in FIG. 5. A depth L2 is 0.15 mm and the angle θ2 of the bottom defined by the side faces 3*b* and 3*c* is 90°.

Twenty-five grooves 5*a* are spirally formed by using a YAG laser in such a fashion that gaps L1 of the grooves 5*a* in the rotating direction of the roller bar 3 is 2 mm, and an angle θ1 to a line A—A (FIG. 4) parallel to the shaft centerline of the roller bar 3 (line A—A extending into the depth of the sheet of drawing in FIG. 5) is 7.5°. As a result, an angle θ3 (FIG. 5) between the line 3*b* in FIG. 5 and a tangent (that can be approximately regarded as an outer peripheral line 3*d*) at a corner 3*e* formed by the line 3*b* and the outer peripheral line 3*d* of the roller bar 3 is 135°.

Similarly, twenty-five grooves 5*b* are formed, each being different from grooves 5*a* in that the position of the groove with respect to line A—A (FIG. 4), is different. Grooves 5*b* define an angle θ4 of 7.5° with respect to lines A—A. Incidentally, the formation positions of the grooves 5*b* with respect to the grooves 5*a* in the rotating direction of the roller bar 3 may be decided arbitrarily.

Figure 6:
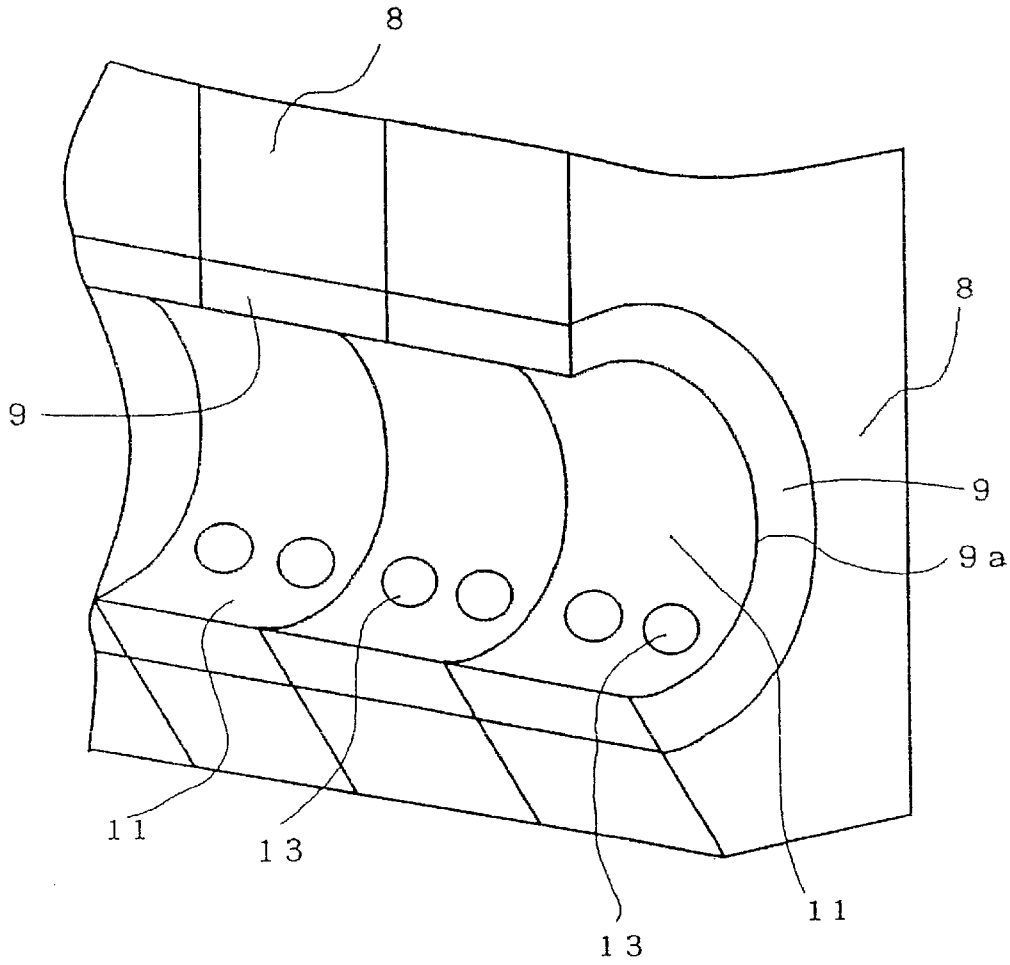
FIG. 6 is a partial enlarged perspective view of a holding member 8.
Figure 7:
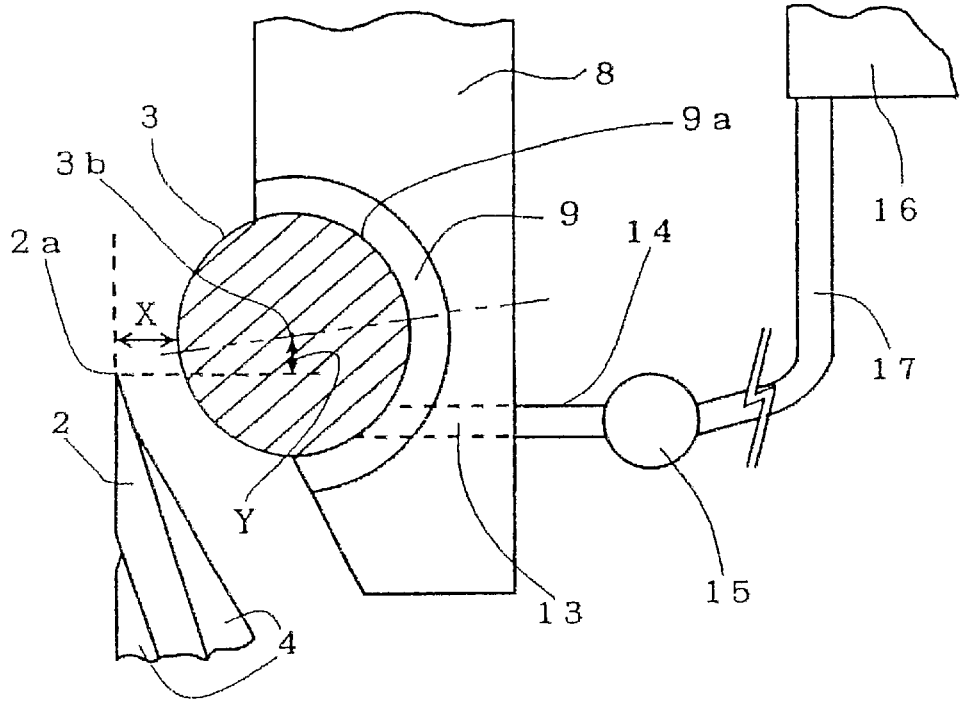
FIG. 7 is a partial sectional explanatory view of a section taken along a line VII—VII in FIG. 3.

FIG. 6 is a perspective view and FIG. 7 is a partial sectional explanatory view taken along line VII—VII of FIG. 3. A holding member 8 equipped with a plain bearing for rotatably supporting the roller bar 3 is constituted in the following way.

A large number of holding members 8 (FIG. 2) are fixed at their upper end to a pressure bar table 7 (FIG. 1) constituted integrally with the knife carriage 4 in a cantilever arrangement and in parallel with the edge of the knife 2 with a predetermined width (e.g., 35 mm). The lower end of each holding member 8 is cut off into an arcuate shape. A plain bearing 9 is fitted and fixed to each cut-off position as shown in FIGS. 6 and 7.

The inner diameter of each plain bearing 9 is set to a value that is greater (by about 0.1 mm maximum) than a value for holding the roller bars 3 without clearance, that is 16 mm. The plain bearing 9 has an arcuate shape opening to the log side on the section crossing the shaft centerline of the roller bars 3 (that is, on the left side in FIG. 7). Further, the plain bearing 9 has an inner peripheral surface 11 for covering the roller bar 3 in an area greater than the semicircle of the roller bar 3. In this way a groove 9*a* is formed and therefore, the roller bar 3 held does not jump out from inside the plain bearing 9 due to its own weight.

A through-hole that is to function as a water feed passage 13 is bored in the inner peripheral surface 11.

A large number of holding members 8 are aligned and fixed to knife carriage 4 in accordance with the length of the log to be cut in parallel with the edge of the knife 2 as shown in FIGS. 2 and 6. Consequently, the grooves 9*a* of the adjacent sliding bearings 9 come into conformity with one another in both vertical and transverse directions, as shown in FIG. 7. The roller bar 3 is inserted from the right side in FIG. 6 into the grooves 9*a* under this condition. The fixing position to the knife carriage 4 is decided so that the position of the roller bar 3 so inserted to the knife 2 attains the position to be later described.

The position of the roller bar 3 relative to the knife 2 will be explained with reference to FIG. 7.

The sharpness angle of the knife 2 is set to 22° and its clearance angle is set to 1°, for example. The knife 2 is fixed in advance to the knife carriage 4 in such a fashion that its edge 2*a* is positioned on the same horizontal line as the center of revolution of the spindles S.

When a 2 mm-thick veneer layer is to be cut out under this condition, for example, a gap X between a cutting estimation line that is expected to be cut by the knife 2 and the peripheral surface of the roller bar 3 is positioned and fixed in a distance of 1.6 mm as 80% of 2 mm. The imaginary cutting line is shown as a dotted line extending vertically upward from the edge 2*a* in FIG. 7. When the center of revolution of the roller bar 3 is 3*b*, the gap Y between the dotted line extending horizontally from the edge 2*a* in FIG. 7 (hereinafter called the "edge horizontal line") and the center of revolution 3*b* is positioned and fixed at a position of a distance of 3.8 mm.

When an oblique two-dot-chain line passing through the center of revolution 3*b* and forming an angle of 11° 30" with respect to the edge horizontal line is assumed in FIG. 7 at the position of the roller bar 3 that is set for cutting the 2 mm-thick veneer layer as described above, the roller bar 3 is set in such a fashion that the center of revolution 3*b* reciprocates on this two-dot-chain line. To this object, the holding members 8 are provided to the knife carriage 4 in such a fashion as to be capable of reciprocating. However, this arrangement is the same as the construction of known veneer lathes, and its explanation will be omitted.

When the position of the knife edge 2*a* with respect to the roller bar 3 must be changed because a change in the thickness of the veneer layer is desired, the roller bar 3 may well be moved and fixed so that the gap X attains a desired distance. When a 6 mm-thick veneer layer is to be cut out, for example, the roller bar 3 needs to be moved upwardly to the right under the condition described above so that the gap X attains 4.8 mm as 80% of 6 mm in FIG. 7.

On the other hand, the following construction is employed for the end portions 3*a* of the roller bar 3 where the diameter is somewhat smaller.

In other words, a similar construction to the holding members 8 each having the plain bearing 9 is employed as shown in FIGS. 2 and 3. In addition, two holders 10 are fixed to the pressure bar table 7 with a gap between them to rotatably hold the end portions 3*a*. A sprocket (not shown) is fixed to the portion of the end portions 3*a* interposed between the two holders 10. A chain 12 driven by a motor 18 (FIG. 1) having a torque limiter for limiting a transmission torque is hooked on the sprocket, and the roller bar 3 is driven for rotation at a peripheral speed of 60 m/min, for example.

As shown in FIG. 7, a large number of water feed passages (hereinafter "passages") 13 formed in each holding member and extend from the back of the holding members 8 to the inner peripheral surface 11 of the plain bearing 9 in which grooves 9*a* are provided. A tube 14 is connected to each passage 13 as shown in FIG. 7. Each tube 14 is connected to a pipe 15 which extends to a length substantially equal to the entire width of the holding members 8 as a whole in parallel with the edge of the knife 2 and both ends of which are closed. A tank 16 is filled with water and is disposed above the pipe 15, which is connected to tank 16 by tube 17. Consequently, water is always supplied to the grooves 9*a* by gravitational force.

As shown in FIG. 1, two female screw holes 19*a* (the second is blocked from view in FIG. 1) make up a first moving mechanism and are fixed to the knife carriage 4 in a spaced apart relation in a direction crossing the moving direction of the knife carriage 4. A male screw 19*b* is inserted into each female screw hole 19*a*. A detector 20 is connected to male screws 19*b* and serve as a log diameter detection mechanism for detecting a radius of the log. The detector 20 is a rotary encoder, for example, for detecting the distance between the center of rotation of the log 1 and the position of the edge of the knife 2 by measuring the number of revolutions of male screws 19*b*. A variable speed driving source 21 such as a servo motor is provided so as to rotate male screws 19*b*.

In the construction described above, when both male screws 19*b* are integrally rotated by the variable speed driving source 21 under control of a control mechanism 22, discussed below, the knife carriage 4 is moved at an arbitrary or predetermined speed to the left in FIG. 1 during cutting of the log, and to the right when cutting is completed and the knife carriage 4 returns to the original position.

An oil hydraulic cylinder (not shown) serves as a spindle operation mechanism for operating the pair of spindles S and allowing them to reciprocate relative to the log 1. A center driving apparatus including a revolution indicator 23 and a variable speed driving source 24 is connected to the spindles S as shown in FIG. 1. Among them, the revolution indicator 23 is a rotary encoder and serves as a measuring mechanism for measuring the number of revolutions of the spindles S per unit time, and the variable speed driving source 24 is a DC motor for rotating and driving the spindles S.

In the construction described above, the control mechanism 22 controls the spindles S so that the log 1 rotates always at the same peripheral speed and is cut by the knife 2 to provide the veneer layer T even when the log 1 is cut by the knife 2 and its diameter decreases as the knife carriage 4 moves towards the log 1. In other words, receiving the signal from the detector 20, the control mechanism 22 executes control so that the number of revolutions increases in accordance with the distance between the center of revolution of the log 1 and the edge of the knife 2. The spindles S supply a part of the power necessary for cutting the log 1 to the axial portion of the log. Incidentally, the peripheral speed described above is set to a value somewhat smaller than the peripheral speed of the roller bar 3 (for example, 58 m/min).

On the other hand, two male screws 30*b* serve as a second moving mechanism and are arranged at positions opposing the male screws 19*b* on the opposite side of the knife carriage 4 with the spindles S being the center in the spaced-apart relation in a direction crossing the moving direction of the knife carriage 4 as shown in FIG. 1.

A support table 31, having fixed thereto a female screw hole 30*a* engaged with male screw 30*b*, is connected to each of the two male screws 30*b*, and the support tables 31 are arranged at opposite ends of the apparatus (into the paper in FIG. 1).

Figure 8:
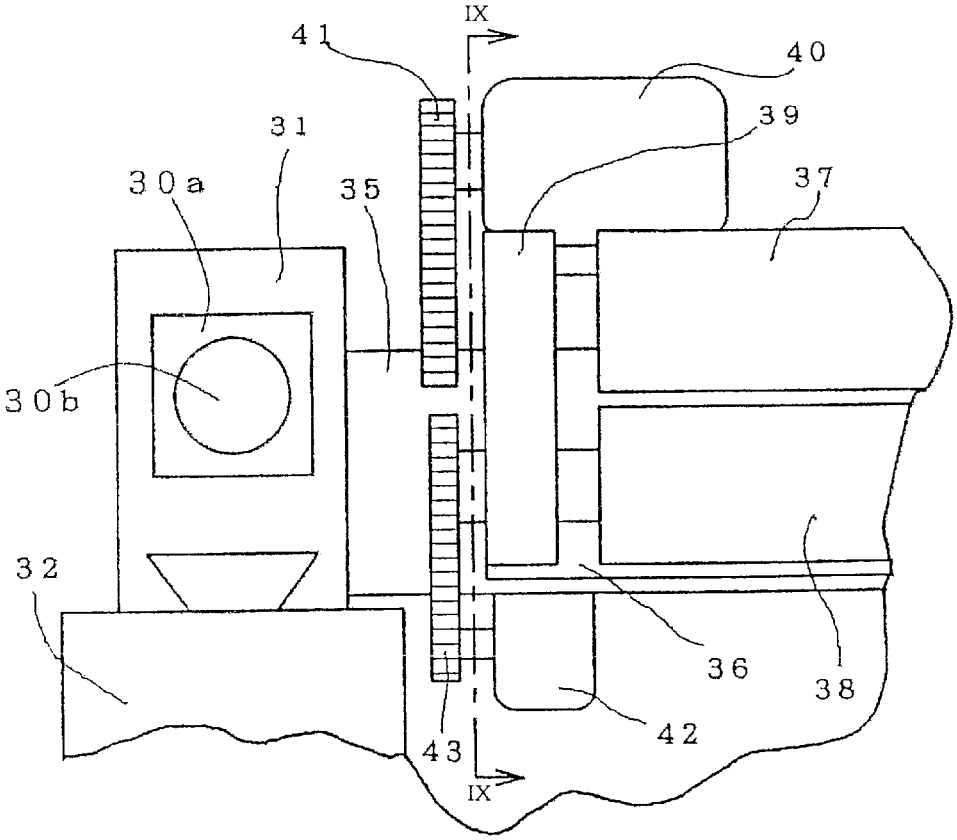
FIG. 8 is a partially enlarged explanatory front view showing a state where a material wood 1 is removed, taken along line VIII—VIII in FIG. 1.

FIG. 8 is a partial front view of the veneer lathe as viewed along line VIII—VIII in FIG. 1. The log 1 has been omitted from FIG. 8. Each support table 31 is engaged with a base 32 and is arranged horizontally by means of a dovetail groove as shown in FIG. 8. Each support table 31 is so guided as to move linearly and horizontally, that is, to the right and left as indicated by the arrow in FIG. 1.

A variable speed driving source 34 such as a servo motor including a detector 33 for detecting the distance between the center of revolution of the log 1 and the peripheral surfaces of rolls 37 and 38, discussed below, and a rotary encoder are provided for each male screw 30*b*, as shown in FIG. 1.

Figure 9:
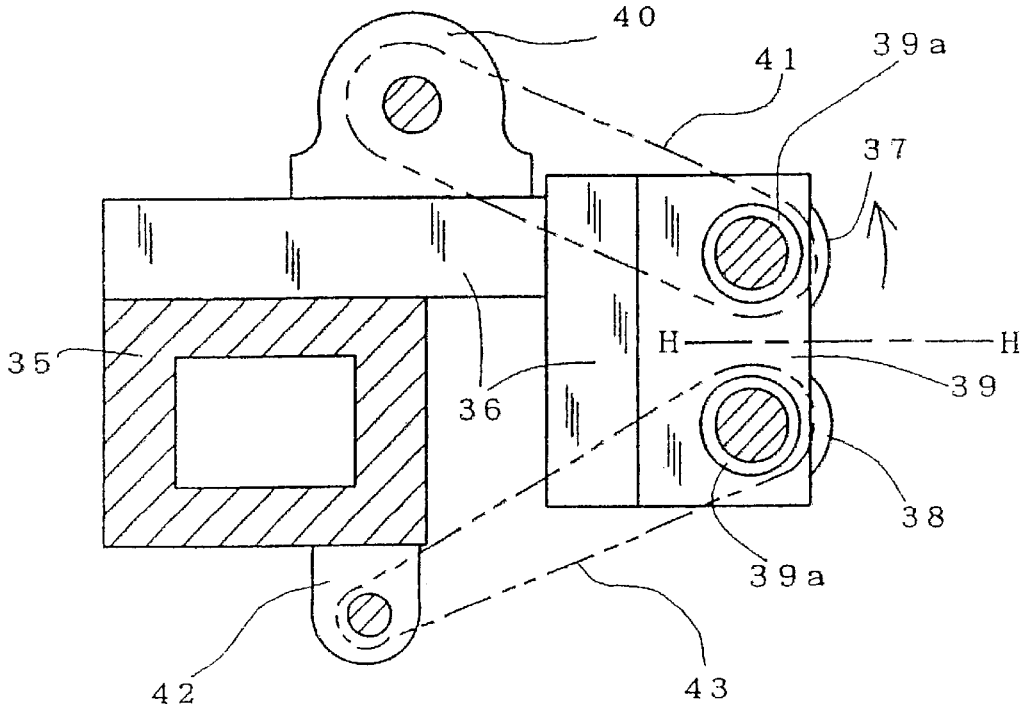
FIG. 9 is a partial sectional explanatory view of a section taken along a line IX—IX in FIG. 8.

On the other hand, FIG. 9 is a partial sectional view taken along line IX—IX in FIG. 8. A fitting table 35 has a hollow prismatic body shape and is arranged between both support tables 31, as shown in FIGS. 8 and 9. As shown, both end portions of fitting table 35 are fixed to the support tables 31.

A holding table 36 is fixed to the fitting table 35 at a position near the center between both support tables 31 where it does not impede traveling of chain 41 and timing belt 43, discussed below, as shown in FIG. 8. As can be seen clearly from FIG. 9, the holding table 36 has an L-shaped side surface, and its length in a direction crossing the moving direction of the support table 31 is smaller than the length of the fitting table 35.

As shown in FIGS. 8 and 9, a support table 39 is fixed to the holding table 36. The support table 39 rotatably supports both ends of two rollers 37 and 38 by means of a bearing 39*a* at positions corresponding to the centers of rollers 37 and 38. An imaginary horizontal line H—H, that passes through the center of revolution of the log 1, is indicated by a one-dot-chain line shown in FIG. 9 and extends in a direction perpendicular to the axial direction of the log. The rollers 37 and 38 have a length in the axial direction a little greater than the length of the log 1 and a diameter of 115 mm with the gap of 145 mm between their centers of revolution.

A motor 40 is fixed to the upper surface of the holding table 36 as shown in FIGS. 8 and 9. A chain 41 (indicated by two-dot-chain line in FIG. 9) transmits the revolution of the motor 40 to the rollers 37, so that the rollers 37 can always rotate in the direction of the arrow at a peripheral speed (62 m/min, for example) that is a little higher than the peripheral speed of the roller bar 3.

A pulse counter 42, which serves as a number-of-revolution measuring mechanism that counts pulses generated when the shaft thereof is rotated, is fixed to the lower surface of the fitting table 35. A gear (not shown) is fixed to the shaft of each of the pulse counter 42 and the roller 38. A timing belt 43 (indicated by two-dot-chain line in FIG. 9) is wound on both gears to transmit the revolution of the roller 38 to the pulse counter 42.

The revolution signal of the roller 38 transmitted to the pulse counter 42 is transmitted to the control mechanism 22, and the number of revolutions of the log 1 per unit time is measured by using also the signal from the detector 20 as will be described later.

In the construction described above, the variable speed driving source 34 synchronously rotates both screws 30*b* under control of control mechanism 22. Consequently, rollers 37 and 38 connected to the support tables 31 are moved at an arbitrary or predetermined speed in the direction of the arrow in FIG. 1.

In the construction described above, the control mechanism 22 may be constituted so as to control each member in the following manner.

When cutting of the log 1 is started, the revolution of the male screws 30*b* moves the support tables 31 in the direction away from the log so that the rollers 37 and 38 leave the log 1, and only the spindles S keep contact with the log 1 and are driven for rotation.

The control mechanism 22 receives the signal of the number-of-revolutions per unit time of the spindles S, that is, the number-of-revolutions per unit time of the log 1, calculated by the revolution indicator 23, transmits an operation signal (hereinafter called the "first operation signal") to the variable speed driving source 21 on the basis of this signal so that the thickness of the veneer layer to be cut attains a predetermined value (such as 2 mm), or in other words, so that the knife carriage 4 moves towards the log 1 at a rate of 2 mm per revolution of the log 1, and moves the knife carriage 4.

As a continuous web-like veneer is cut from the log 1, the control mechanism 22 receives a signal inputted manually by an operator, actuates the variable speed driving source 34, and moves the support tables 31 towards the log 1 at a speed higher than the moving speed of the knife carriage 4.

Next, when the distance between the center of revolution of the log 1 acquired from the detector 33 and the peripheral surface of the rollers 37 and 38 reaches the position equal to the distance between the center of revolution of the log 1 acquired from the detector 20 and the edge of the knife 2 (strictly speaking, the position on the Archimedean spiral curve that takes the thickness of the veneer into consideration), the control mechanism 22 thereafter outputs the signal for moving the support tables 31 at the same speed as that of the knife carriage 4 towards the log 1, to the variable speed driving source 34.

As a result, the rollers 37 and 38 move towards the center of revolution of the log 1 while they are always kept in pressure-contact with the peripheral surface of the log 1 the diameter of which decreases progressively with the progress of cutting.

The roller 38 that is brought into pressure-contact with the log 1 is so rotated as to follow the revolution of the log 1, and the timing belt 43 transmits the revolution of this roller 38, that is, the peripheral speed of the log 1, to the pulse counter 42. The pulse counter 42 calculates the number of revolutions of the log 1 per unit time in each minute time interval set in advance by the control mechanism 22 from this signal and the signal of the distance between the center of revolution of the log 1 and the edge position of the knife 2, that sequentially changes and is acquired from the detector 20. The pulse counter 42 calculates a signal (hereinafter called the "second operation signal") at which the moving distance of the knife carriage 4 towards the log 1 per revolution of the log 1 at this number of revolutions attains 2 mm. At this point of time, however, the first operation signal is still transmitted to the variable speed driving source 21 but the second operation signal is not yet transmitted to the variable speed driving source 21.

As cutting proceeds from the condition described above, the control mechanism 22 switches the first operation signal to the variable speed driving source 21 used first for moving the knife carriage 4 to the second operation signal by means of a signal representing the result of detection that the distance between the center of revolution of the log 1 acquired from the detector 20, and the position of the edge of the knife 2 reaches the distance set in advance to a value a little greater than the radius of the spindles S (such as 60 mm; hereinafter called the "first distance") that can be regarded as the radius of the log, to thereby keep the movement of the knife carriage 4. After switching, the control mechanism 22 outputs a signal for moving back the spindles S and separating them from the log 1.

As cutting further proceeds and the distance between the center of revolution of the log 1 and the position of the edge of the knife 2 acquired from the detector 20 reaches the distance set in advance (hereinafter called the "second distance") such as 40 mm, the control mechanism 22 sends an operation stop signal to the variable speed driving sources 21 and 34, stops the movement of the knife carriage 4 and the rollers 37 and 38 towards the log 1, and moves them back in mutually departing directions.

The embodiment of the invention having the construction described above provides the following function and effect.

To start cutting, the rollers 37 and 38 are kept separated from the log 1 and only the spindles S are brought into contact with the log 1 and are driven for rotation. Receiving the signal from the revolution indicator 23, the control mechanism 22 transmits the first operation signal to the variable speed driving source 21 so as to keep the thickness of the cut veneer layer to be constant, and moves the knife carriage 4. Incidentally, the spindles S are controlled so that the number of revolutions increases in association with the distance between the center of revolution of the log 1 and the edge of the knife 2 as described above. Therefore, as the knife carriage 4 moves towards the log 1, the number of revolutions per unit time increases serially as the knife carriage 4 moves towards the log 1.

Then, the peripheral surface of the roller bar 3 is pushed to the peripheral surface of the log 1. The motor for driving and rotating the roller bar 3 is provided with the torque limiter as described already. Consequently, the peripheral speed of the roller bar 3 is reduced by the log 1, and attains substantially the same peripheral speed as that of the log. Power is supplied from the roller bar 3 and from the spindles S, and knife 2 starts cutting the veneer layer T.

Figure 10:
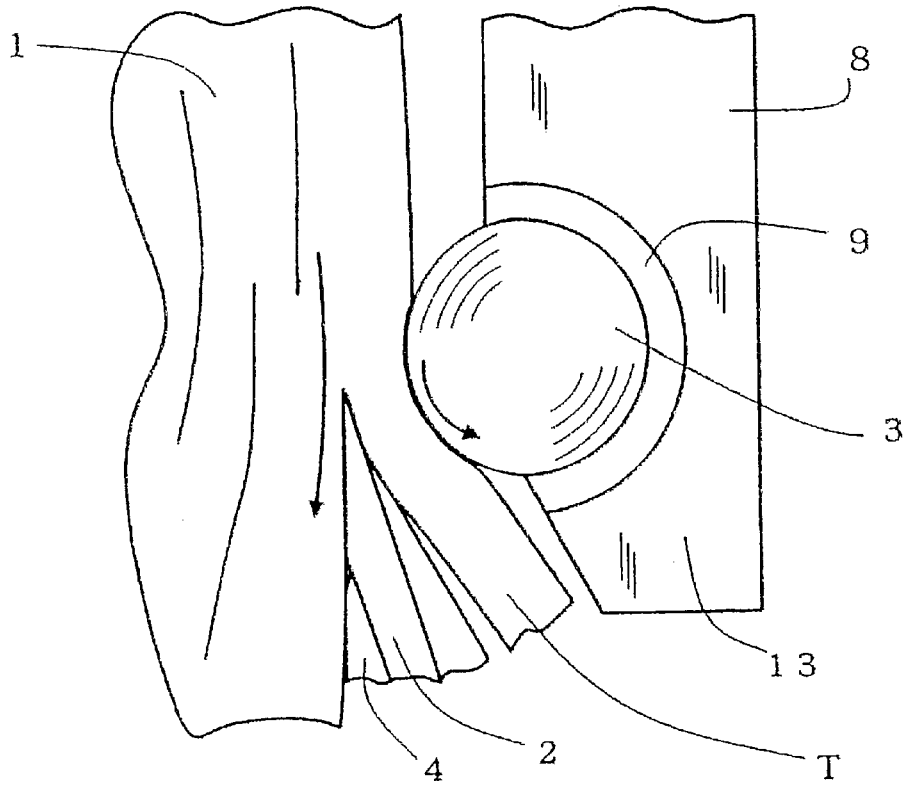
FIG. 10 is a partially enlarged explanatory side view of a portion near a knife 2 and a roller bar 3 in FIG. 1.

FIG. 10 shows the cutting state of the log 1 in the same positional relation as in FIG. 7, and shows the periphery of the roller bar 3. The cutting is carried out in a manner shown in FIG. 10, to obtain a veneer layer T.

Figure 11:
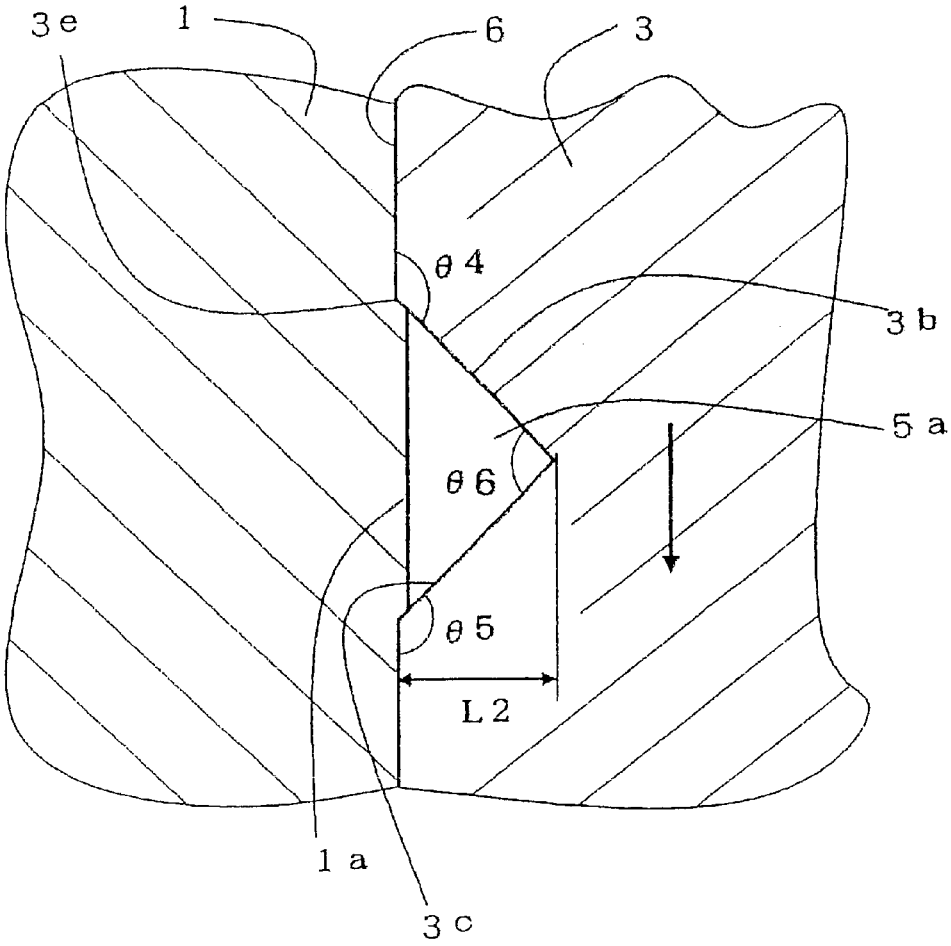
FIG. 11 is an enlarged view of principal portions in a section crossing a shaft centerline direction of the roller bar 3 in FIG. 10.

FIG. 11 is an enlarged view of the principal portions in the section crossing the shaft centerline direction of the roller bar shown in FIG. 10 during this cutting operation. As already explained with reference to FIG. 7, the distance X (FIG. 7) is set to 80% of the thickness of the veneer layer T to be cut out and the roller bar 3 brings the log into compressive deformation. Therefore, the corner 3*e* of the groove 5*a*, for example, of the roller bar 3 rotating in the direction of the arrow in FIG. 11 cuts and anchors into the peripheral surface 1*a* of the log 1. Therefore, force can be sufficiently transmitted from the roller bar 3 to the log 1.

The angle θ3 of the corner 3*e* is set to 135° as described already. Therefore, the scratch remaining in the peripheral surface of the log can be hardly recognized visually, and the veneer T obtained by cutting can be used as face veneer.

Incidentally, the angle θ3 is the angle in the section in the direction crossing the extending direction of the grooves 5*a* as described above, and the angle θ4 in the section crossing the centerline axis (A—A) of the roller bar 3, that is, in the section on the upstream side of the roller bar rotating direction in FIG. 11 in the section taken along line XI—XI in FIG. 4 (hereinafter called the "angle in the crossing section") is somewhat greater than 135° of the angle θ3.

When the angle in the crossing section is increased, the scratch appearing in the veneer T becomes small. However, it becomes more difficult to anchor the corner 3*e* to the peripheral surface of the log 1, and the force that can be transmitted to the log 1 becomes smaller. When the angle in the crossing section is decreased, on the contrary, it becomes easier to anchor the corner 3*e* to the peripheral surface 1*a* of the log 1, but the scratch appearing on the veneer T becomes great.

Experiments are carried out by changing the angle in the crossing section within the thickness range of 1 to 3 mm for the veneer to be cut out by using beech and birch as the kind of wood in which surface scratches occur relatively easily. As a result, the condition of the scratch appearing in the veneer and the magnitude of the force that can be transmitted from the roller bar are tabulated in Table 1.

TABLE 1

| Angle of crossing section (θ4) | scratch appearing in veneer | transmissible force |
|---|---|---|
| 125° | noticeable | Sufficient |
| 130° | slightly noticeable | Sufficient |
| 150° | almost unnoticeable | Sufficient |
| 160° | almost unnoticeable | a bit insufficient |
| 165° | Fair | Insufficient |

It can be understood from the result tabulated above that the angle (θ4) in the crossing section that can be employed falls within the range of 130 to 160°.

Incidentally, the angle θ5 on the downstream side in the rotating direction of the roller bar 3 corresponding to θ4 in FIG. 11 hardly has influences as the force to be transmitted to the log 1. Therefore, this angle may well be set to an angle different from θ4 such as a smaller angle provided that the scratch appearing in the veneer T does not render any problem. Consequently, when the corner on the downstream side releases the inside of the grooves while the roller bar 3 keeps contact at the corner on the upstream direction in the rotating direction after the groove comes into contact with the log, catches and anchors to the log, this release can be achieved more quickly if θ5 is smaller, so that the fiber dust staying in the groove can be discharged more easily. When the angle θ5 is equal to θ4, or preferably, when the angle θ3 in FIG. 5 is equal to the angle on the downstream side in the roller bar rotating direction corresponding to this angle θ3, machining for forming the grooves becomes easier. When the bottom angle θ6 becomes wider and exceeds 90° and the roller bar rotates to open its grooves downward, the fiber dust is discharged by its own weight, and the force can be smoothly transmitted from the roller bar to the log. Incidentally, when θ6 is greater than 70° in relation with the coefficient of friction between the log and the steel material, the fiber dust hardly clogs the grooves but is similarly discharged. Table 2 below tabulates two sets of angles θ5 and θ6 relative to θ4.

TABLE 2

| angle θ4 of crossing section | θ5 when θ6 is 90° | θ6 when θ4 = θ5 |
|---|---|---|
| 130° | 140° | 80° |
| 150° | 120° | 120° |
| 160° | 110° | 140° |

Because the diameter of the roller bar 3 is set to about 16 mm, the smooth peripheral surface 6 of the roller bar 3 other than the grooves 5*a* and 5*b* can push the log immediately ahead of the knife 2 as shown in FIG. 11, and a veneer layer having fewer cracks on the back can be acquired.

As to the entire roller bar 3, on the other hand, the smooth surface 6 can be consecutively kept by the inner peripheral surface 11 of the holding member 8 at the position first set, and an excellent veneer T can be obtained under a desired condition.

Because water is always supplied from the tank 16 to the grooves 9*a*, water so supplied enters the grooves 5*a* and 5*b* of the roller bar 3 with the revolution of the roller bar 3 and adheres to the entire inner peripheral surface 11, as well. As water adheres to the peripheral surface of the roller bar 3 as a whole, it provides lubrication and cooling effects when the roller bar 3 is positioned on the inner peripheral surface 11 and rotates.

Confirming visually that cutting is consecutively carried out as described above and the continuous web-like veneer is cut out from the log 1, the operator manually applies the signal to the control mechanism 22. Receiving this signal, the control mechanism 22 generates the signal for actuating each member, and actuates each member.

In other words, the variable speed driving source 34 is operated and the support tables 31 are moved towards the log 1 at a moving speed higher than that of the knife carriage 4. The detectors 33 and 20 detect the point of time at which the distance between the center of revolution of the log 1 and the peripheral surfaces of the rollers 37 and 38 becomes equal to the distance between the center of revolution of the log 1 and the position of the edge of the knife 2. Thereafter, the rollers 37 and 38 are moved towards the center of revolution of the log 1 while keeping pressure-contact with the peripheral surface of the log 1 at the same speed as that of the knife carriage 4 under the state shown in FIG. 1.

Because the rollers 37 and 38 keep this pressure-contact state, the force of the knife 2 to the log 1 in the horizontal direction prevents deflection of the log 2 even when cutting proceeds and the diameter of the log 1 becomes smaller. Further, because the peripheral speed of the roller 37 is set as described above, the roller 37 imparts the force in the rotating direction to the log 1 while slipping on the peripheral surface of the log 1, and supplies a part of the power necessary for cutting.

As cutting further proceeds under this condition, the detector 20 sends the signal representing that the distance between the center of revolution of the log 1 and the edge of the knife 2 is equal to the first distance described above, to the control mechanism 22. Receiving this signal, the control mechanism 22 switches the first operation signal to the variable speed driving source 21 that is used for first moving the knife carriage 4, to the second operation signal also described above, and continues to similarly move the knife carriage 4. Next, the operation signal from the control mechanism 22 moves back the spindles S and separates them from the log 1.

Figure 12:
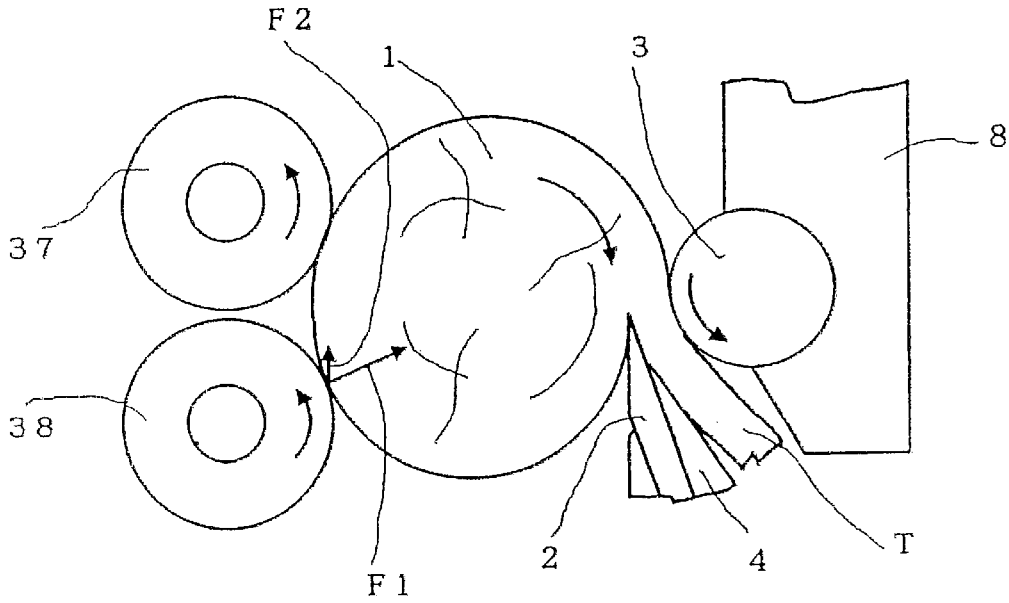
FIG. 12 is an explanatory view showing a cutting state where spindles are removed from a material wood.

Even after the spindles S move back, the force F1 in the direction towards the center of revolution of the log 1, that is, the force in the obliquely upward direction, acts from the roller 38 to the log 1 as shown in FIG. 12 as a partial enlarged explanatory view. The component of force F2 of this force F1 in the perpendicular direction operates mainly as the force that prevents the log 1 from falling down, and drives and rotates the log 1 while the roller bar 3 and the rollers 37 and 38 hold the log 1. In this way, the knife 2 keeps cutting consecutively.

As cutting further proceeds and the detector 20 detects that the distance between the center of revolution of the log 1 and the position of the edge of the knife 2 attains the second distance, the control mechanism 22 transmits the operation signal and stops the revolution of both sets of male screws 19*b* and 30*b* and the movement of both knife carriage 4 and support tables 31 towards the log 1. Next, the sets of male screws 19*b* and 30*b* are rotated in the opposite direction to move the knife carriage 4 and the support tables 31 in the departing direction from the log 1. Then, the remaining round rod-like log 1 or a so-called "cut core" drops due to its own weight. As the operations described above are repeated, the log is cut in this embodiment.

The embodiment described above may be modified in the following ways.

Figure 13:
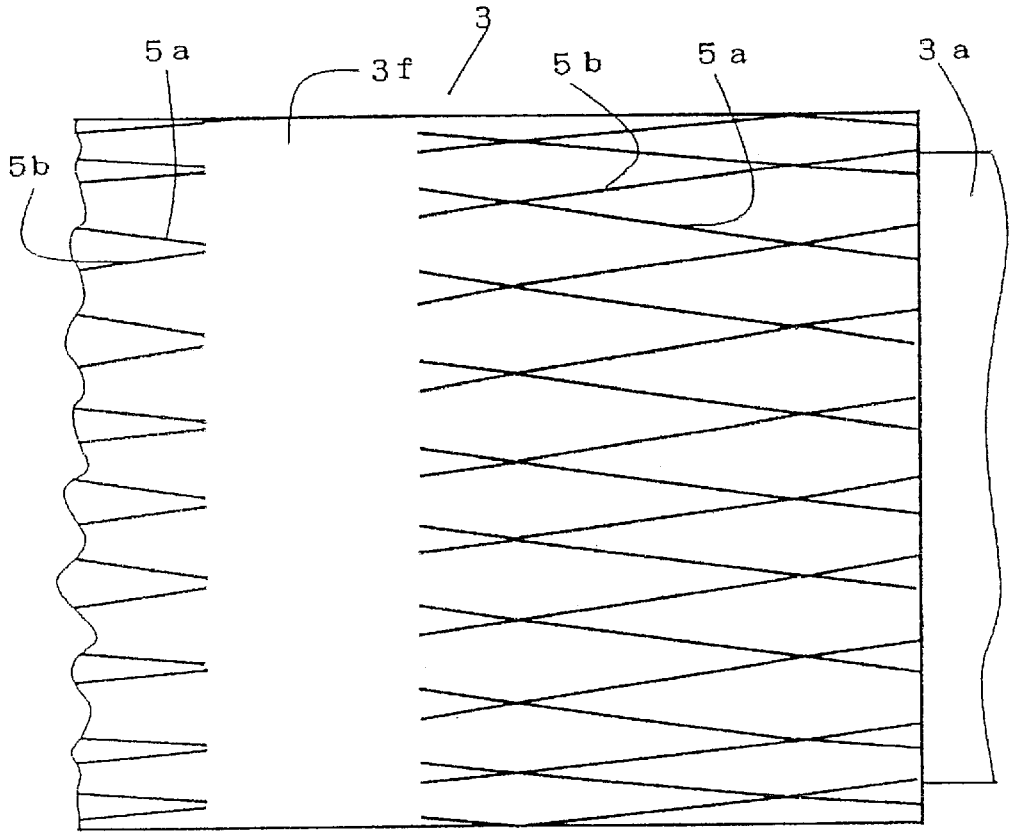
FIG. 13 is a partial enlarged explanatory view of a modified example of grooves formed in a peripheral surface of the roller bar.

1. The grooves 5*a* and 5*b* to be formed in the peripheral surfaces of the roller bar 3 may be formed in such a fashion that portions where the grooves 5*a* and 5*b* are formed in the shaft centerline direction of the roller bar 3 and smooth peripheral surfaces 3*f* not having the grooves 5*a* and 5*b* are alternately disposed with predetermined widths, as shown in FIG. 13.

According to this construction, the force transmitted to the log by the roller bar 3 becomes smaller, but the inner peripheral surface 11 of the holding member 8 can keep the peripheral surface 3*f* at positions set more stably.

Figure 14:
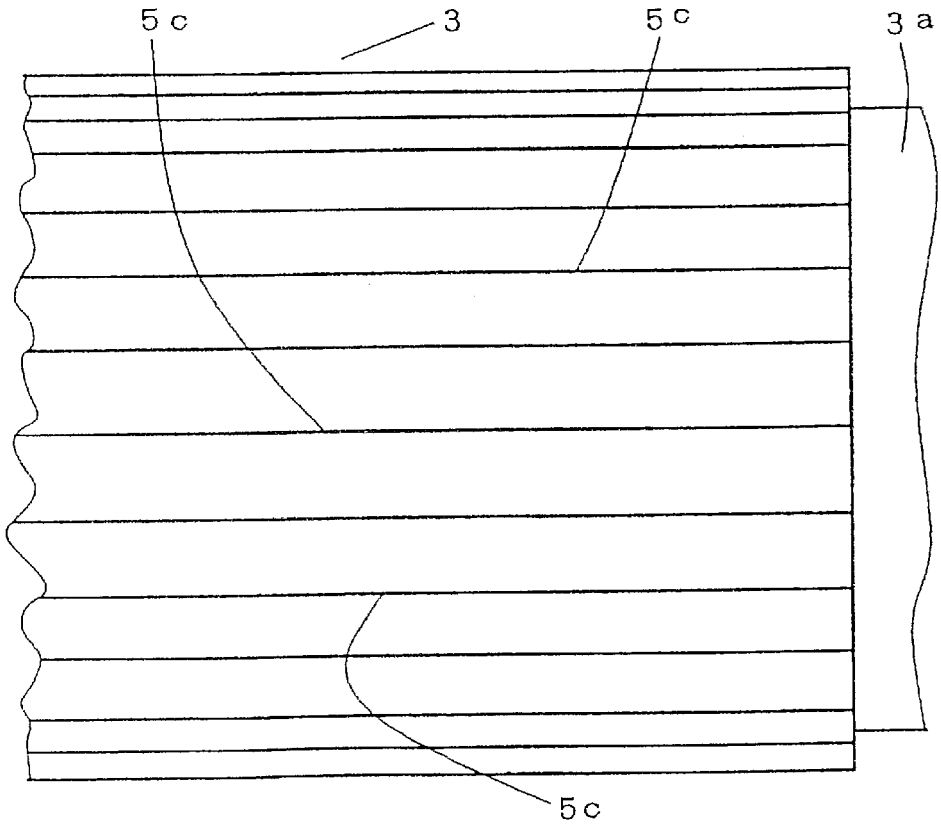
FIG. 14 is a partial enlarged explanatory view of a modified example of grooves formed in a peripheral surface of the roller bar.

2. The grooves to be formed in the peripheral surface of the roller bar may also be grooves 5*c* formed in parallel with the shaft centerline of the roller bar 3 as shown in FIG. 14. In this case, the portions where the grooves 5*c* are formed in the shaft centerline direction of the roller bar 3 and the smooth peripheral surfaces 3*f* where the grooves 5*c* are not formed may be alternately disposed in predetermined widths in the same way as in the example shown in FIG. 13.

In the modified forms 1 and 2 described above, the portions with the grooves and the smooth peripheral surfaces 3*f* are alternatively disposed. However, it is also possible to dispose at least two portions with at least two different groove depths.

3. In the embodiment described above, the diameter of the roller bar 3 is set to 16 mm. However, roller bars having a diameter of at least 12 mm but not greater than 20 mm exhibit the function as the pressure bar to effectively push the log at a position immediately before the knife, and can transmit power to the log. Further, when the thickness of the resulting veneer is greater than 3 mm as mentioned before, the diameter of the roller bar may be greater, for example, approximate 30 mm.

Figure 15:
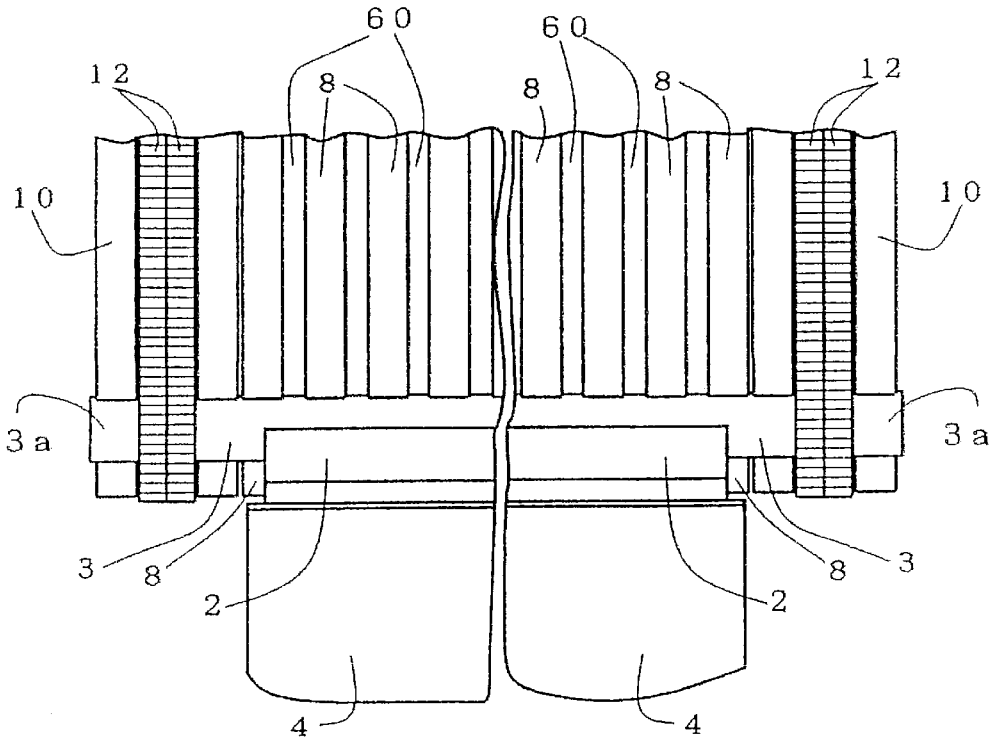
FIG. 15 is an explanatory front view of a modified example of the arrangement state of a plain bearing.

4. In the embodiment described above, the sliding bearings 9 of the roller bar equipped with the holding member 8 are aligned without any gap and in parallel with the edge of the knife 2 as shown in FIG. 2, for example. However, the sliding bearings 9 may also be disposed with gaps between them by securing gaps 60 between adjacent holding members 8 as shown in FIG. 15.

5. In the holding member described above, the plain bearing is provided at the other end of the bar opposite to the end which is fixed to the knife carriage 4. However, this construction may be modified in the following way.

Figure 16:
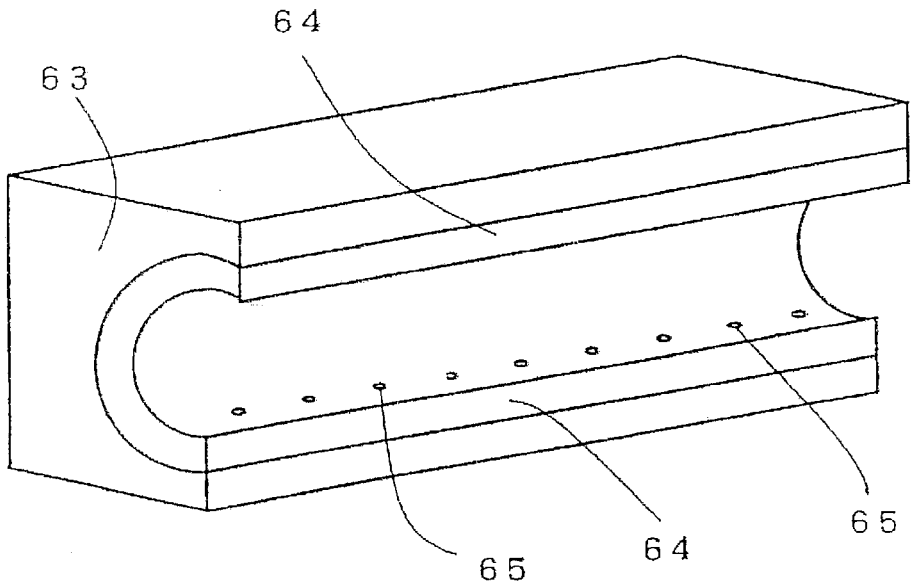
FIG. 16 is a perspective view of a modified example of the plain bearing.
Figure 16:
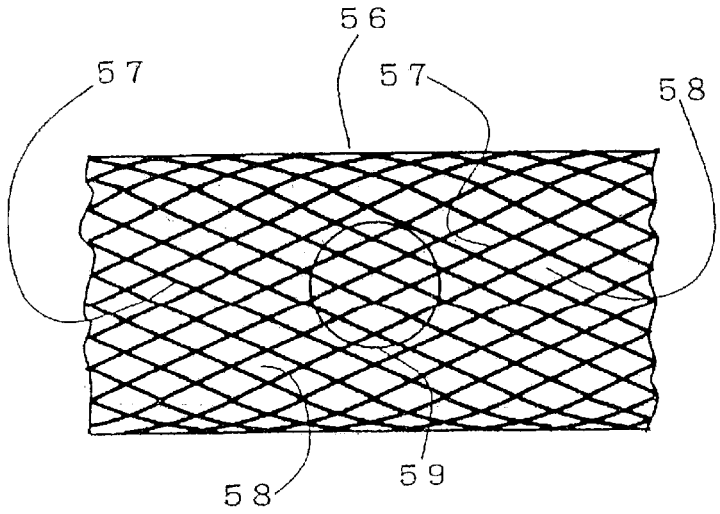

In other words, as shown in the perspective view of FIG. 16, the holding member 63 is changed to a rectangular holding member 63, and one of the side surfaces of this holding member 63 is cut into an arcuate shape. A plain bearing 64 having the same construction as the plain bearing 9 is fitted and fixed to this cut portion. Various roller bars described already may be fitted to this plain bearing 64.

6. Though one roll is shown used in FIGS. 2 and 15, the length of the roller bar in the shaft centerline direction may be divided at the center in the transverse direction of the drawings, and each plain bearing 9 may be used to rotatably support the divided parts.

7. The embodiment described above employs the construction wherein the female screw 30*a* and the male screw 30*b* engaging each other and disposed at the positions opposing the knife so function as to move the rollers 37 and 38, as the back-up roller that moves and follows the peripheral surface of the log, the diameter of which progressively decreases with the progress of cutting. However, a known oil-pressure or air-pressure cylinder having a similar construction may be used to move the rollers 37 and 38.

As described above, the veneer lathe according to the present invention cuts the log and provides a veneer that is substantially free from scratches, and thus suitable for use as a surface sheet of plywood. The veneer lathe according to the present invention also prevents the wood fiber chips of the logs after cutting from clogging the grooves of the roller bar, and can stably transmit the force to the log.

What is claimed is:

1. A veneer lathe comprising:

a knife for cutting a rotating log, said knife being fixed to a knife carriage;

a roller bar provided at a position upstream of said knife in a log rotating direction for pushing a peripheral surface of the log, said roller bar comprising a plurality of grooves formed in a peripheral surface thereof;

sliding bearings for rotatably supporting said roller bar, said sliding bearings being fixed to said knife carriage and having, when viewed in a section crossing a centerline axis of said roller bar, an arcuate sectional shape opening towards the log and being positioned on a side of said roller bar that is opposite to a side of said roller bar that faces the log; and a driving source for rotating said roller bar supported by said sliding bearings;

wherein the shape of each of said grooves, when viewed in said section crossing the centerline axis of said roller bar, is such that an angle between a tangent at a corner of said groove on the upstream side of said roller bar in said rotating direction, which is constituted by a line on an outer periphery of said roller bar, and a first line extending outward from an upstream side face defining said groove, is 130 to 160 degrees.

2. A veneer lathe according to claim 1, wherein said grooves are spirally disposed in the peripheral surface of said roller bar.

3. A veneer lathe according to claim 1, wherein said grooves are disposed in the peripheral surface of said roller bar in parallel with the direction of the centerline axis of said roller bar.

4. A veneer lathe according to claim 1, wherein said grooves and smooth peripheral surfaces are alternately arranged on said roller bar in the direction of the centerline axis of said roller bar.

5. A veneer lathe according to claim 1, wherein said sliding bearings are arranged dividedly in the direction of the centerline axis of said roller bar.

6. A veneer lathe according to claim 1, wherein said sliding bearings are arranged with gaps between them in the direction of the centerline axis of said roller bar.

7. A veneer lathe according to claim 1, further comprising a holder fixed at one end to said knife carriage in a cantilever arrangement and coupled to said sliding bearings at the other end thereof.

8. A veneer lathe according to claim 1, wherein said roller bar has a diameter of not greater than 20 mm.

9. A veneer lathe according to claim 1, further comprising a backup roller facing the log at a position opposite to said knife, said backup roller moving so as to follow the peripheral surface of the log while the diameter of the log becomes smaller.

10. A veneer lathe comprising:

a knife for cutting a rotating log, said knife being fixed to a knife carriage;

a roller bar provided at a position upstream of said knife in a log rotating direction for pushing a peripheral surface of the log, said roller bar having a plurality of grooves formed in a peripheral surface thereof;

sliding bearings for rotatably supporting said roller bar, said sliding bearings being fixed to said knife carriage and having, when viewed in a section crossing a centerline axis of said roller bar, an arcuate sectional shape opening towards the log, and being positioned on a side of said roller bar that is opposite to a side of said roller bar that faces the log; and a driving source for rotating said roller bar supported by said sliding bearings;

wherein the shape of each of said grooves, when viewed in said section crossing the centerline axis of said roller bar, is such that:

a first angle between a tangent at a corner of said groove on the upstream side of said roller bar in said rotating direction, which is constituted by a line on an outer periphery of said roller bar, and a first line extending outward from an upstream side face defining said groove is 130 to 160 degrees, a second angle between a second line extending outward from the downstream side face defining said groove and said first line is at least 70 degrees, and a depth from the outer peripheral surface of each said roller bar to the bottom of said groove is at least 0.05 mm.

11. A veneer lathe according to claim 10, wherein said grooves are spirally disposed in the peripheral surface of said roller bar.

12. A veneer lathe according to claim 10, wherein said grooves are disposed in the peripheral surface of said roller bar in parallel with the direction of the centerline axis of said roller bar.

13. A veneer lathe according to claim 10, wherein said grooves and smooth peripheral surfaces are alternately arranged on said roller bar in the direction of the centerline axis of said roller bar.

14. A veneer lathe according to claim 10, wherein said sliding bearings are arranged dividedly in the direction of the centerline axis of said roller bar.

15. A veneer lathe according to claim 10, wherein said sliding bearings are arranged with gaps between them in the direction of the centerline axis of said roller bar.

16. A veneer lathe according to claim 10, further comprising a holder fixed at one end to said knife carriage in a cantilever arrangement and coupled to said sliding bearings at the other end thereof.

17. A veneer lathe according to claim 10, wherein said roller bar has a diameter of not greater than 20 mm.

18. A veneer lathe according to claim 10, further comprising a backup roller facing the log at a position opposite to said knife, said backup roller moving so as to follow the peripheral surface of the log while the diameter of the log becomes smaller.

* * * * *